US011114787B2

(12) United States Patent
Jung

(10) Patent No.: US 11,114,787 B2
(45) Date of Patent: Sep. 7, 2021

(54) TERMINAL FOR CONNECTOR MOUNTED TO PRINTED CIRCUIT BOARD AND CONNECTOR SUPPORTING SAID TERMINAL

(71) Applicant: LG Chem, Ltd., Seoul (KR)

(72) Inventor: Sang-Eun Jung, Daejeon (KR)

(73) Assignee: LG Chem, Ltd. (KR)

( * ) Notice: Subject to any disclaimer, the term of this patent is extended or adjusted under 35 U.S.C. 154(b) by 0 days.

(21) Appl. No.: 16/757,853

(22) PCT Filed: Jun. 12, 2019

(86) PCT No.: PCT/KR2019/007045
§ 371 (c)(1),
(2) Date: Apr. 21, 2020

(87) PCT Pub. No.: WO2019/245221
PCT Pub. Date: Dec. 26, 2019

(65) Prior Publication Data
US 2021/0083412 A1 Mar. 18, 2021

(30) Foreign Application Priority Data
Jun. 22, 2018 (KR) ..... 10-2018-0072158

(51) Int. Cl.
*H01R 12/72* (2011.01)
*H01R 13/11* (2006.01)
(Continued)

(52) U.S. Cl.
CPC ..... *H01R 12/721* (2013.01); *H01R 13/112* (2013.01); *H01R 13/187* (2013.01); *H01R 13/631* (2013.01)

(58) Field of Classification Search
CPC ... H01R 12/721; H01R 13/112; H01R 13/187
(Continued)

(56) References Cited

U.S. PATENT DOCUMENTS 3,097,906 A * 7/1963 Shannon ..... H01R 13/35 439/855
3,641,473 A * 2/1972 Attaway ..... H01R 4/64 439/108
(Continued)

FOREIGN PATENT DOCUMENTS

CN 1537345 A 10/2004
CN 101102015 A 1/2008
(Continued)

OTHER PUBLICATIONS

International Search Report for PCT/KR2019/007045 dated Sep. 26, 2019; 3 pages.
(Continued)

*Primary Examiner* — Peter G Leigh
(74) *Attorney, Agent, or Firm* — Lerner, David, Littenberg, Krumholz & Mentlik, LLP

(57) ABSTRACT

A connector terminal including a cable fixing unit connected to a signal transmission cable, an upper contact-pressing unit configured to extend in one direction from the cable fixing unit, and a lower contact-pressing unit configured to extend from the cable fixing unit in parallel to the upper contact-pressing unit with a predetermined gap from the upper contact-pressing unit. At least one of the upper contact-pressing unit and the lower contact-pressing unit is provided to be elastically movable to increase or decrease the gap.

15 Claims, 7 Drawing Sheets

(51) Int. Cl.
*H01R 13/187* (2006.01)
*H01R 13/631* (2006.01)

(58) Field of Classification Search
USPC ..... 439/59
See application file for complete search history.

(56) References Cited

U.S. PATENT DOCUMENTS

| | | | | | |
|---|---|---|---|---|---|
| 4,700,997 | A * | 10/1987 | Strand | A61B 5/274 | 439/372 |
| 4,797,125 | A * | 1/1989 | Malana | A61B 5/274 | 439/729 |
| 5,035,641 | A | 7/1991 | Van-Santbrink et al. | | |
| 5,238,411 | A | 8/1993 | Jinno et al. | | |
| 5,454,739 | A * | 10/1995 | Strand | A61B 5/274 | 439/729 |
| 6,312,294 | B1 | 11/2001 | Lai | | |
| 6,357,089 | B1 * | 3/2002 | Koguchi | A61B 5/274 | 24/536 |
| 8,025,507 | B2 * | 9/2011 | Kim | H01R 12/7064 | 439/79 |
| 8,529,281 | B2 * | 9/2013 | Nakatsuji | H01R 24/20 | 439/345 |
| 8,535,080 | B2 * | 9/2013 | Nakatsuji | H01R 12/81 | 439/345 |
| 8,790,121 | B2 * | 7/2014 | Hirakawa | H01R 12/721 | 439/63 |
| 9,437,937 | B2 * | 9/2016 | Tamaki | H01R 13/113 | |
| 9,629,952 | B2 * | 4/2017 | Heppe | A61M 1/3653 | |
| 2002/0177332 | A1 | 11/2002 | Hubbard et al. | | |
| 2008/0003858 | A1 | 1/2008 | Little et al. | | |
| 2008/0220639 | A1 | 9/2008 | Ohara | | |
| 2010/0255694 | A1 | 10/2010 | Kim et al. | | |
| 2012/0196468 | A1 | 8/2012 | Nakatsuji et al. | | |
| 2013/0040505 | A1 | 2/2013 | Hirakawa | | |
| 2014/0357097 | A1 | 12/2014 | Endo et al. | | |
| 2016/0064845 | A1 | 3/2016 | Endo | | |
| 2018/0123276 | A1 * | 5/2018 | Fertig | H01R 12/7088 | |

FOREIGN PATENT DOCUMENTS

| | | | |
|---|---|---|---|
| CN | 101299491 | A | 11/2008 |
| CN | 201690078 | U | 12/2010 |
| CN | 202373754 | U | 8/2012 |
| CN | 204966788 | U | 1/2016 |
| FR | 2615660 | A1 | 11/1988 |
| JP | 2001035598 | A | 2/2001 |
| JP | 2002093503 | A | 3/2002 |
| JP | 2005062076 | A | 3/2005 |
| JP | 2007214087 | A | 8/2007 |
| JP | 2008305734 | A | 12/2008 |
| JP | 2012156116 | A | 8/2012 |
| JP | 2013239345 | A | 11/2013 |
| JP | 2014209417 | A | 11/2014 |
| JP | 2017216103 | A | 12/2017 |
| KR | 200372568 | Y1 | 1/2005 |
| KR | 100486687 | B1 | 5/2005 |
| KR | 20100025409 | A | 3/2010 |
| KR | 20100110023 | A | 10/2010 |
| KR | 101183473 | B1 | 9/2012 |
| KR | 101400463 | B1 | 5/2014 |
| KR | 20150080040 | A | 7/2015 |
| KR | 20180039936 | A | 4/2018 |
| WO | 2018101910 | A1 | 6/2018 |

OTHER PUBLICATIONS

Search Report from Chinese Office Action for Application No. 201980007263.6 dated Feb. 7, 2021; 3 pages.

Extended European Search Report including Written Opinion for Application No. EP19823669.7 dated Mar. 12, 2021, 13 pgs.

* cited by examiner

TERMINAL FOR CONNECTOR MOUNTED TO PRINTED CIRCUIT BOARD AND CONNECTOR SUPPORTING SAID TERMINAL

CROSS-REFERENCE TO RELATED APPLICATIONS

The present application is a national phase entry under 35 U.S.C. § 371 of International Application No. PCT/KR2019/007045 filed Jun. 12, 2019, published in Korean, which claims priority from Korean Patent Application 10-2018-0072158 filed Jun. 22, 2018, all of which are incorporated herein by reference.

TECHNICAL FIELD

The present disclosure relates to a connector terminal and a connector including the terminal, and more particularly, to a connector terminal, which is useable as a terminal for a direct printed circuit board (PCB) connector and is capable of holding a PCB at upper and lower portions even though the thickness of the PCB is changed, and a connector including the terminal.

BACKGROUND ART

Recently, electronic devices such as laptops, tablet PCs and smart phones as well as a battery management system (BMS) used for charging or discharging products using secondary batteries have become increasingly compact and lightweight, and accordingly the density of electronic elements mounted to a circuit substrate thereof is also increasing. Thus, there is a demand for light, thin, short and small connector devices.

A conventional connector generally includes a female connector and a male connector in a pair. The female connector has a plurality of pins corresponding to a contact, and the male connector has a plurality of plug terminals that come into contact with the plurality of pins. The male connector is mounted to a circuit board by means of Surface Mounter Technology (SMT), and the female connector is complementarily coupled with the male connector.

However, if both the female connector and the male connector are used, different bodies and contacts of the female connector and the male connector should be prepared using different molds, and any one connector must be surface-mounted to a circuit board, which makes the manufacturing process complicated and increases the manufacturing cost.

As an alternative to the connector including a pair of male and female connectors, Patent Literature 1 (KR10-2010-0110023) discloses a connector provided to reduce the manufacturing cost by decreasing the number of parts and to be fastened to an edge region of a printed circuit board. Also, Patent Literature 2 (KR10-1400463) discloses a connector having a very simple electric connector configuration by excluding an electrical connector and the like of a mating partner.

However, if the conventional direct PCB connector is repeatedly installed in a printed circuit board (PCB) having a large thickness tolerance, the interval of the terminals is increased, thereby seriously weakening the contact resistance and the contact pressure on the printed circuit board.

If the contact pressure of the direct PCB connector and its terminal onto the printed circuit board is insufficient, the contact between the printed circuit board and the connector or terminal may become poor due to vibration or shock. Thus, it is needed to find complementary measures thereto.

SUMMARY

Technical Problem

The present disclosure is directed to providing a terminal, which is useable for a direct PCB connector and is capable of preventing a PCB from being deviated or poorly contacted by holding the PCB at upper and lower portions thereof even though the thickness of the PCB is changed, and a connector including the terminal.

It may be clearly understood by those skilled in the art from the following description that embodiments according to the present disclosure may solve the technical problems not mentioned above.

Technical Solution

In one aspect of the present disclosure, there is provided a connector terminal, comprising: a cable fixing unit configured to connect to a signal transmission cable; an upper contact-pressing unit extend lengthwise in a first direction from the cable fixing unit; and a lower contact-pressing unit extending lengthwise in the first direction parallel to the upper contact-pressing unit with a gap defining a distance between the upper contact-pressing unit and the lower contact-pressing unit, wherein at least one of the upper contact-pressing unit or the lower contact-pressing unit is configured to be elastically movable to increase or decrease the gap.

The upper contact-pressing unit may include a support part configured to maintain a constant distance from the lower contact-pressing unit; and an elastic displacing part connected to the support part by means of an elastic member to be movable in a second direction that is not parallel to the first direction.

The support part and the lower contact-pressing unit may be integrally formed with the cable fixing unit.

The support part may have a coupling groove formed by depressing a surface thereof by a predetermined depth, wherein the surface faces the elastic displacing part, and the elastic member may include a block inserted into the coupling groove and protruding from the surface of the elastic displacing part; and at least one spring interposed between the coupling groove and the block.

The at least one spring may include a plurality of springs arranged symmetrically at an upper surface and a lower surface of the block.

The at least one spring may be either a leaf spring or a coil spring.

The at least one spring may be a plurality of leaf springs positioned at predetermined intervals along a longitudinal direction of the block, wherein each leaf spring may have a center portion fixed to the block, and ends extending from the center portion and separated by a predetermined width.

The constant distance between the support part and the lower contact-pressing unit may be greater than a distance between the elastic displacing part when the elastic member is not moved and the lower contact-pressing unit.

The elastic displacing part may include one or more first guide protrusions, and the lower contact-pressing unit may include one or more second guide protrusions, wherein the first and second guide protrusions may protrude toward each other.

In another aspect of the present disclosure, there is also provided a connector, which is directly mounted to a circuit board, comprising: the connector terminal as described in any of the embodiments herein; and a connector housing configured to accommodate the connector terminal and configured to be installed at an edge of the circuit board, wherein the connector housing includes an upper plate and a lower plate including respective front portions spaced apart from each other so that the edge of the circuit board is capable of being inserted between the upper plate and lower plate to a predetermined depth; and respective rear portions connected to each other to form a single body, and wherein at least one of the upper plate and the lower plate includes a clamping part configured to clamp the circuit board in a second direction that is perpendicular to the first direction.

A portion of the clamping part may be fitted into the upper plate in the second direction, and the portion of the clamping part may be shaped in a saw-tooth pattern inclined in one direction.

The connector housing may further include holding ribs provided to respective opposing side surfaces of the connector housing, and each holding rib may include an approximately U-shaped terminal section into which the circuit board is capable of being fitted.

The connector housing may further include a latch portion configured to be hooked to a fastening hole positioned in the circuit board in advance, the upper plate may include a first upper plate part and a second upper plate part, and the latch portion may be a lever type including a hooking protrusion positioned at a first end thereof and configured to be hooked to and unhooked from the fastening hole so that the first end is lifted when an opposing second end is pressed down, and wherein the latch portion is positioned between the first upper plate part and the second upper plate part.

Advantageous Effects

According to an embodiment of the present disclosure, it is possible to provide a terminal, which is useable for a direct PCB connector and is capable of preventing a PCB from being deviated or poorly contacted by holding the PCB at upper and lower portions thereof even though the thickness of the PCB is changed, and a connector including the terminal.

In particular, since the terminal according to the present disclosure is configured such that its upper and lower ends are elastically movable, the terminal may be applied to a flexible flat cable (FFC) and a flexible printed circuit board (FPCB) as well as PCBs having different thicknesses.

DETAILED DESCRIPTION

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Therefore, the description proposed herein is just a preferable example for the purpose of illustrations only, not intended to limit the scope of the disclosure, so it should be understood that other equivalents and modifications could be made thereto without departing from the scope of the disclosure.

A connector, explained below, may be defined as an electronic component that is mounted to ends of two or more wires or signal cables to electrically couple one circuit (or device) and another circuit (or device). In addition, a connector terminal is an internal component of the connector and may be defined as a metal conductor used to electrically connect a strand of the wire or signal cable to a conductive pattern 21 of the circuit board.

Figure 1:
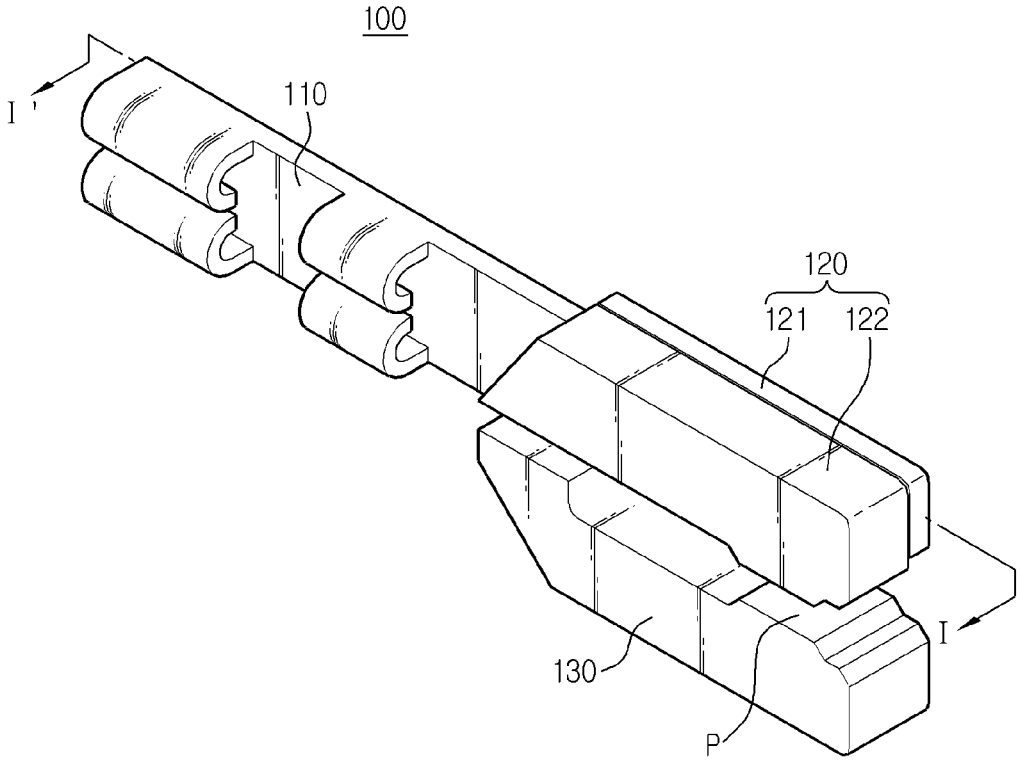
FIG. 1 is a perspective view showing a connector terminal according to an embodiment of the present disclosure.
Figure 2:
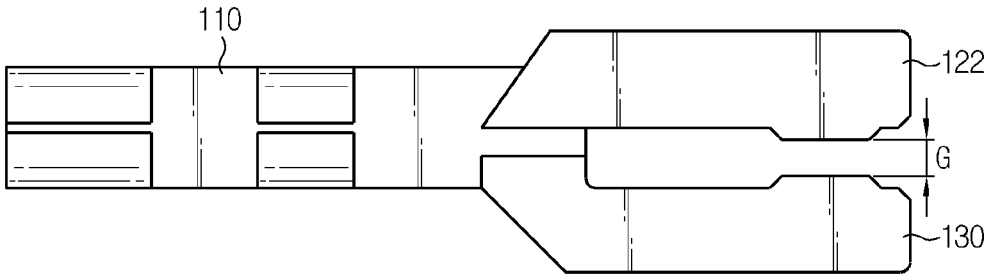
FIG. 2 is a side view showing the connector terminal depicted in FIG. 1.
Figure 3:
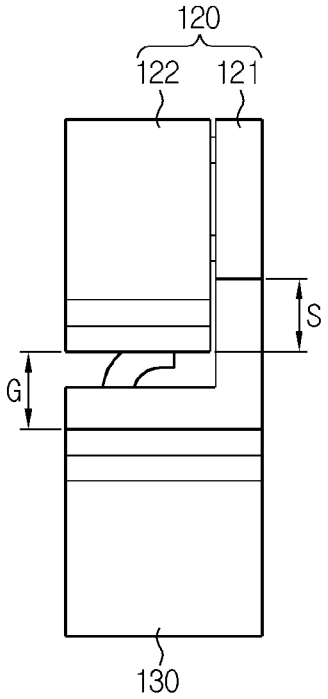
FIG. 3 is a front view showing the connector terminal depicted in FIG. 1.

FIG. 1 is a perspective view showing a connector terminal according to an embodiment of the present disclosure, FIG. 2 is a side view showing the connector terminal depicted in FIG. 1, and FIG. 3 is a front view showing the connector terminal depicted in FIG. 1.

The connector terminal 100 according to an embodiment of the present disclosure includes a cable fixing unit 110, an upper contact-pressing unit 120, and a lower contact-pressing unit 130, as shown in the figures.

The cable fixing unit 110 is provided to fix an end of a wire or a signal transmission cable. For example, the transmission cable may be inserted into an arc-shaped ring provided at the cable fixing unit 110 in a state where its cover is peeled off at an end thereof. In addition, the end of the transmission cable may be fixed to the cable fixing unit 110 in various ways, such as welding and fitting.

The upper contact-pressing unit 120 and the lower contact-pressing unit 130 are portions that contact the conductive pattern 21 provided at the circuit board 20 when a connector is installed to the circuit board 20.

Referring to FIGS. 2 and 3 together, the upper contact-pressing unit 120 and the lower contact-pressing unit 130 may be disposed to be spaced apart in a vertical direction so as to form a gap therebetween and may be provided to extend in parallel to each other from the cable fixing unit 110. In addition, at least one of the upper contact-pressing unit 120 and the lower contact-pressing unit 130 may be provided to be elastically movable to increase or decrease the gap.

As explained later in detail, if the connector terminal 100 according to an embodiment of the present disclosure is used, the circuit board 20 may be inserted between the upper contact-pressing unit 120 and the lower contact-pressing unit 130, and at this time, the gap between the upper contact-pressing unit 120 and the lower contact-pressing unit 130 is widened further due to the circuit board 20 to apply an elastic restoring force, thereby contacting and pressing the upper surface and the lower surface of the circuit board 20 by the elastic restoring force.

In particular, the connector terminal 100 according to an embodiment of the present disclosure may be provided such that the upper contact-pressing unit 120 and/or the lower contact-pressing unit 130 are independently movable by an elastic medium, thereby alleviating the elastic fatigue of the terminal and thus keeping the contact pressure stably even for a long-term or repeated use.

Hereinafter, the structure and operating mechanism of the upper contact-pressing unit 120 and the lower contact-pressing unit 130 of the connector terminal 100 will be described in more detail with reference to FIGS. 4 to 7.

The upper contact-pressing unit 120 according to an embodiment of the present disclosure includes a support part 121 and an elastic displacing part 122.

The support part 121 is integrally formed with the cable fixing unit 110 to maintain a constant gap (G+S) with the lower contact-pressing unit 130 and plays a role of supporting the elastic displacing part 122 to be vertically movable.

Here, as shown in FIG. 3, the constant gap (G+S) means a gap larger than an initial gap G at least between the elastic displacing part 122 and the lower contact-pressing unit 130. In this embodiment, since the gap between the support part 121 and the lower contact-pressing unit 130 is maintained constant, a limit thickness of the circuit board 20 capable of being inserted into the terminal may be regarded as being equal to the size of the gap (G+S).

Of course, if necessary, the size of the gap between the support part 121 and the lower contact-pressing unit 130 may be adjusted as desired due to a design change of the terminal.

The support part 121 faces the elastic displacing part 122 and has a coupling groove 121*a* formed by depressing one surface thereof facing the elastic displacing part 122 to a predetermined depth. The coupling groove 121*a* may be provided to have a large area in a substantially rectangular shape to accommodate the elastic member of the elastic displacing part 122.

Figure 4:
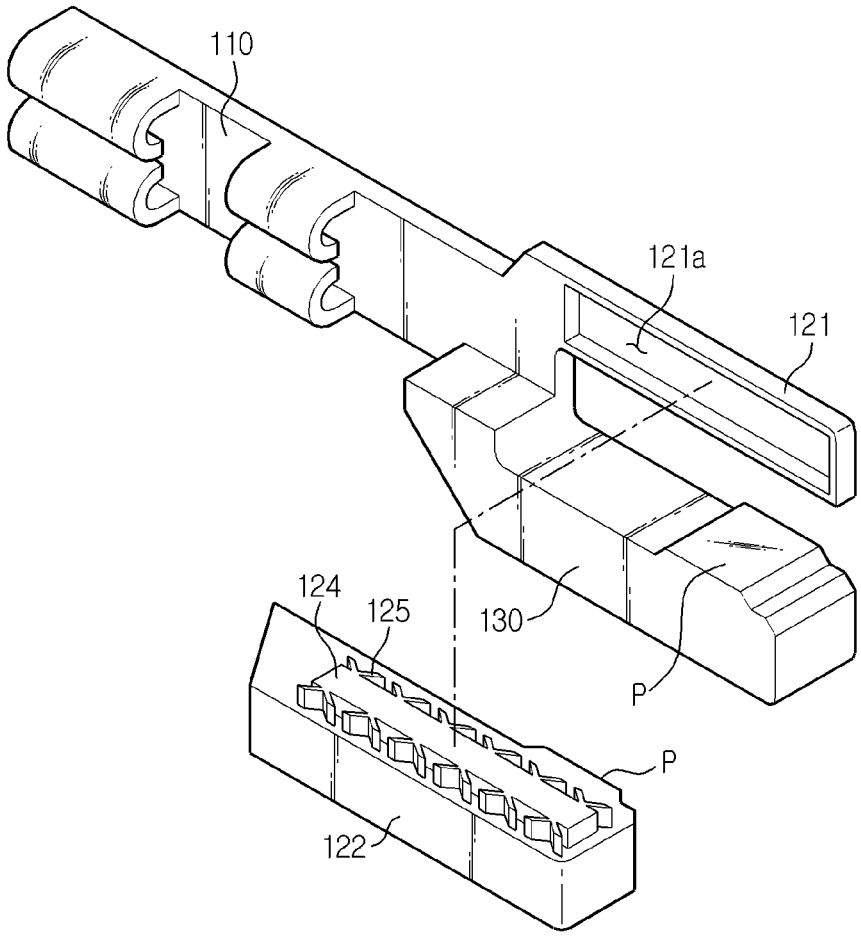
FIG. 4 is a partially exploded perspective view showing the connector terminal depicted in FIG. 1.

The elastic displacing part 122 is configured to be movable up and down with respect to the support part 121 as the elastic member is connected to the support part 121. Seeing the elastic displacing part 122, as shown in FIG. 4, the elastic displacing part 122 may have a shape substantially corresponding to the lower contact-pressing unit 130 and be integrally formed with the elastic member.

The elastic member includes a block 124 formed to protrude from one surface of the elastic displacing part 122 and inserted into the coupling groove 121*a* of the support part 121 and at least one spring 125 interposed between the coupling groove 121*a* and the block 124. A leaf spring 125 may be employed as the at least one spring 125.

Figure 5:
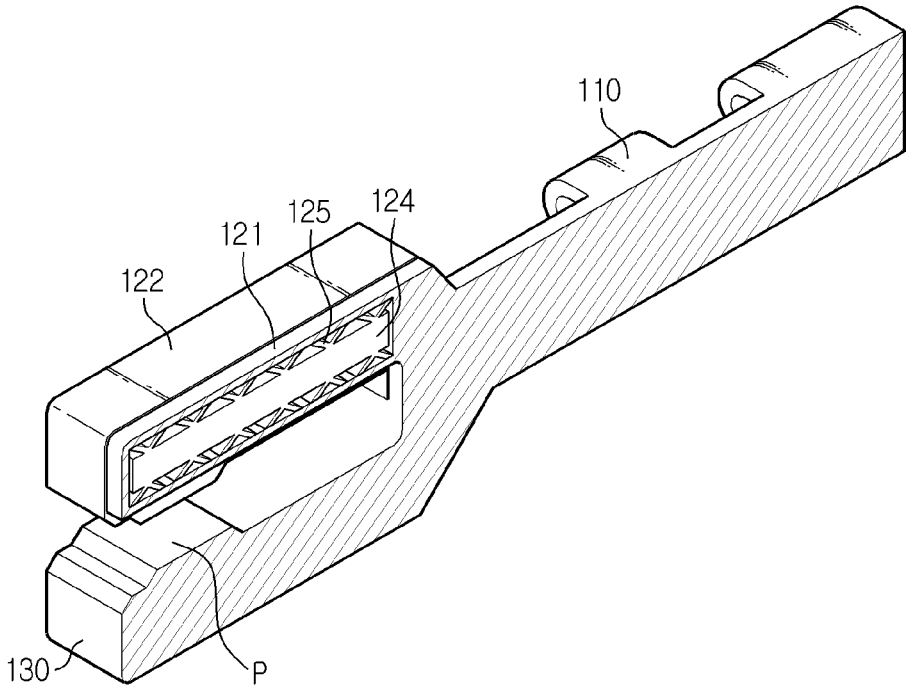
FIG. 5 is a cross-sectioned view, taken along the line I-I' of FIG. 1.

The leaf spring 125 is provided in plural at predetermined intervals along a longitudinal direction of the block 124, and the plurality of springs 125 are symmetrically disposed at the upper surface and the lower surface of the block 124. In addition, the leaf spring 125 has a center portion fixed to the block 124 and both ends opened by a predetermined width with respect to the center portion. Both ends of the leaf spring 125 disposed at the upper surface and the lower surface of the block 124 may be in contact with the upper surface and the lower surface at the inside of the coupling groove 121*a*, as shown in FIG. 5.

The elastic displacing part 122 assembled to the support part 121 may be movable in a direction to increase or decrease the gap with the lower contact-pressing unit 130 with respect to the support part 121 when an external force is applied in a vertical direction.

The elastic displacing part 122 of the upper contact-pressing unit 120 and the lower contact-pressing unit 130 may further include guide protrusions P protruding in opposite directions. The guide protrusion P may have a width gradually decreasing in the protruding direction and then kept constant. The guide protrusion P may be formed to have, for example, an inclined side surface and a flat surface intersecting the side surface.

The guide protrusion P allows the elastic displacing part 122 to be pushed by the front end of the circuit board 12 so as to be easily opened when the circuit board 20 is inserted. In addition, since the guide protrusion P is formed at a position corresponding to the portion where the conductive pattern 21 of the circuit board 20 is located, the contact pressure of the corresponding portion may be further increased.

In this embodiment, the lower contact-pressing unit 130 is integrally formed with the cable fixing unit 110 so as not to be movable. However, it is also possible that the lower contact-pressing unit 130 is configured to be elastically movable, with a configuration similar to the upper contact-pressing unit 120.

Subsequently, the operation mechanism of the connector terminal 100 according to this embodiment will be described briefly with reference to FIGS. 6 and 7.

Figure 6:
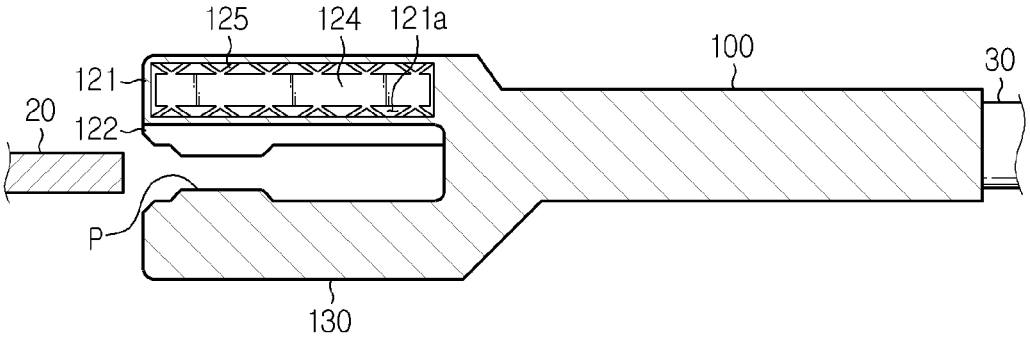
FIGS. 6 and 7 are diagrams for illustrating a mechanism for operating the connector terminal according to an embodiment of the present disclosure.

As shown in FIG. 6, the lower contact-pressing unit 130 and the support part 121 of the upper contact-pressing unit 120 of the terminal are always fixed to keep a constant gap. Also, the initial gap between the elastic displacing part 122 and the lower contact-pressing unit 130 is smaller than the initial gap between the support part 121 and the lower contact-pressing unit 130, and if an external force applied to the elastic displacing part 122 of the upper contact-pressing unit 120, the elastic displacing part 122 may move upward and downward.

Figure 7:
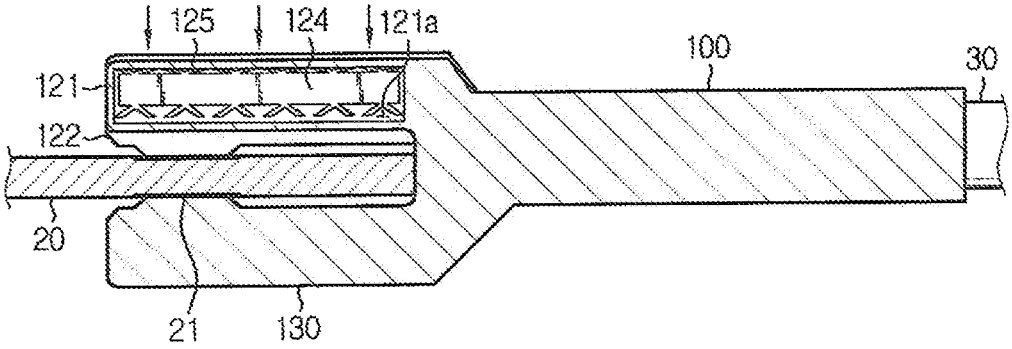

If the circuit board 20 is pushed between the upper contact-pressing unit 120 and the lower contact-pressing unit 130, the elastic displacing part 122 is pushed up due to the guide protrusion P as shown in FIG. 7.

In this case, the leaf springs 125 located at the lower surface of the block 124 fall down from the inner lower surface of the coupling groove 121*a*, and the leaf springs 125 located at the upper portion of the block 124 are attached to the inner upper surface of the coupling groove 121*a* in a state where both ends thereof are opened wider. At this time, the elastic restoring force of the leaf springs 125 acts as a force for the elastic displacing part 122 to hold the circuit board 20.

For example, if it is assumed that the terminal according to an embodiment of the present disclosure is designed such that the gap G between the elastic displacing part 122 and the lower contact-pressing unit 130 as shown in FIG. 3 is 0.2 t and the gap (G+S) between the support part 121 and the lower contact-pressing unit 130 is 1.6 t, the terminal may be applied to FFCs and bus bars as well as printed circuit boards, which have a thickness ranging from 0.2 t to 1.6 t.

Figure 8:
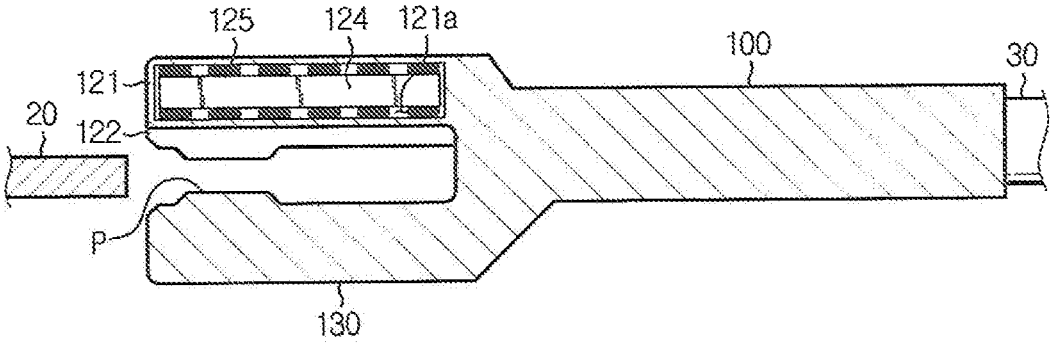
FIGS. 8 and 9 are diagrams for illustrating a mechanism for operating the connector terminal according to another embodiment of the present disclosure.
Figure 9:
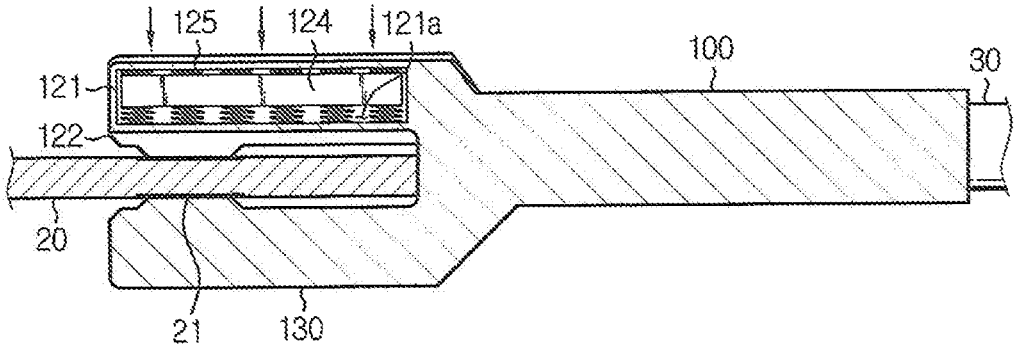

Meanwhile, in this embodiment, the leaf spring 125 is adopted as a substantial essential component for the elastic displacing part 122 to hold the circuit board 20, but the scope of the present disclosure is not limited to the leaf spring 125 only. For example, as shown in FIGS. 8 and 9, the leaf spring 125 may be substituted with a coil spring 125'. The coil spring 125' according to another embodiment of the present disclosure may be manufactured easier than the leaf spring 125 and may be more advantageous in terms of durability and assembling.

Figure 10:
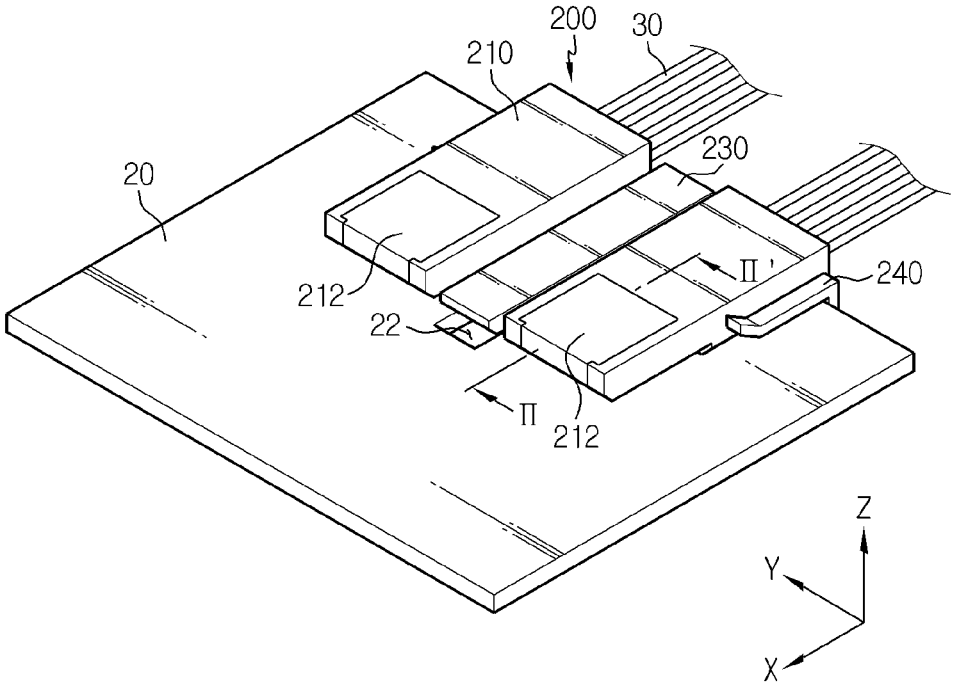
FIG. 10 is a perspective view showing a connector according to an embodiment of the present disclosure, which is mounted to a circuit board.
Figure 11:
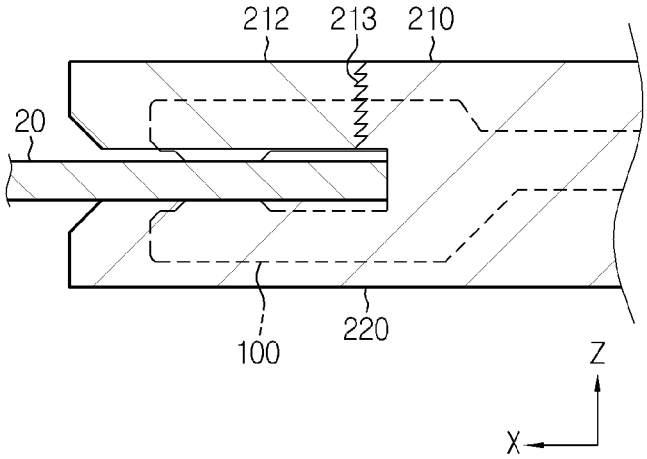
FIGS. 11 and 12 are cross-sectioned views, taken along the line II-Ir of FIG. 10, showing before and after being locked by a clamping part.
Figure 12:
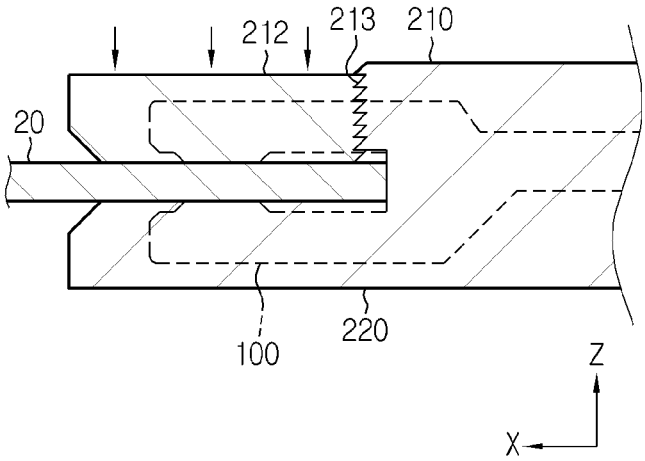

FIG. 10 is a perspective view showing the connector according to an embodiment of the present disclosure, which is mounted to the circuit board 20, and FIGS. 11 and 12 are cross-sectional views, taken along the line II-II' of FIG. 10, showing states before and after being locked by a clamping part 212.

Subsequently, the connector according to an embodiment of the present disclosure will be described with reference to FIGS. 10 to 12.

The connector according to an embodiment of the present disclosure includes the connector terminals 100 as described above and a connector housing 200 configured to accommodate the connector terminals 100 therein and provided to be installed to an edge of the circuit board 20.

The connector housing 200 includes an upper plate 210 and a lower plate 220 for forming a space for accommodating the connector terminal 100, and a latch portion 230 and a holding rib 240 for forming a locking means for the circuit board 20.

The upper plate 210 and the lower plate 220 may be considered as portions forming a body of the connector housing 200.

Front portions of the upper plate 210 and the lower plate 220 are spaced apart in a predetermined interval so that the circuit board 20 may be inserted into a predetermined depth, and rear portions of the upper plate 210 and the lower plate 220 are connected to each other to form a single body. In addition, insert holes for individually inserting the connector terminals 100 are formed in the rear portions of the upper plate 210 and the lower plate 220.

The connector terminals 100 may be inserted through the insert holes to the front portion of the connector housing 200 at a rear side of the connector housing 200. At this time, the cable fixing unit 110 of the connector terminal 100 is inserted into the insert hole and disposed at the rear portion of the connector housing 200, and the upper contact-pressing unit 120 and the lower contact-pressing unit 130 may be disposed at the front portion of the connector housing 200.

Although not shown in the figures in detail for convenience, the connector terminals 100 may be disposed to be partially inserted into individual grooves provided in the connector housing 200 in a Y-axis direction of FIG. 10 so that a creepage distance between the connector terminals 100 is kept constant to prevent a short circuit.

The latch portion 230 is provided to be holed to a fastening hole 22 provided in the circuit board in advance so as to hole the connector not to be deviated from the circuit board 20 in a reverse direction (−X-axis direction).

The latch portion 230 may be in a lever type having a hooking protrusion formed at one end thereof to be hooked to and unhooked from the fastening hole 22 so that one end is lifted when the other end is pressed down. The latch portion 230 may be provided between two divided parts of the upper plate 210 as shown in FIG. 10.

In addition, the holding rib 240 may have a terminal section of an approximately '⊂' shape and be provided to both side surfaces of the connector housing 200. The holding rib 240 may serve to hold the circuit board 20 in a vertical direction.

Also, the connector housing 200 may further include a clamping part 212 provided to at least one of the upper plate 210 and the lower plate 220 to clamp the circuit board 20 in a vertical direction.

Referring to FIGS. 10 to 12, the clamping part 212 according to this embodiment may be in the form of a plate-shaped cover that covers the front portion of the upper plate 210 downward from the top.

For example, the front portion of the upper plate 210 may have a clamping part 212 and a clamping portion cut so that the clamping part 212 is fitted therein.

In particular, the clamping part 212 has a saw-tooth pattern 213 in the upper plate 210, namely in a region that is to be fitted into the clamping portion. The saw-tooth pattern 213 has a slope in one direction. The clamping part 212 having the saw-tooth pattern 213 may be easily fitted into the clamping portion in a −Z-axis direction, but it is very difficult to lift the clamping part 212 in a reverse direction that is +Z-axis direction.

Thus, even though the circuit board 20 having a thickness smaller than the interval between the upper plate 210 and the lower plate 220 of the connector housing 200 is inserted into the connector according to this embodiment as shown in FIG. 11, the clamping part 212 is pressed in the −Z-axis direction as shown in FIG. 12, so that the upper plate 210 and the lower plate 220 of the connector housing 200 are contact-pressed to the upper surface and the lower surface of the circuit board 20. Thus, the connector according to an embodiment of the present disclosure may also be used sufficiently for a circuit board 20 whose thickness is changed due to tolerance or the like.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

Meanwhile, when the terms indicating up, down, left and right directions are used in the specification, it is obvious to those skilled in the art that these merely represent relative locations for convenience in explanation and may vary based on a location of an observer or an object to be observed.

What is claimed is:

1. A connector terminal, comprising:

a cable fixing unit configured to connect to a signal transmission cable;

an upper contact-pressing unit extending lengthwise in a first direction from the cable fixing unit; and a lower contact-pressing unit extending lengthwise in the first direction parallel to the upper contact-pressing unit with a gap defining a distance between the upper contact-pressing unit and the lower contact-pressing unit in a second direction that is not parallel to the first direction, wherein at least one of the upper contact-pressing unit or the lower contact-pressing unit is configured to be elastically movable to increase or decrease the gap, and wherein the upper contact-pressing unit comprises:

a support part integrally formed with the cable fixing unit; and an elastic displacing part connected to the support part by at least one elastic member, wherein the elastic member is configured to apply an elastic restoring force on the elastic displacing part in the second direction.

2. The connector terminal according to claim 1,
wherein the lower contact-pressing unit is integrally formed with the cable fixing unit.

3. The connector terminal according to claim 1,
wherein the support part has a coupling groove formed by depressing a surface thereof by a predetermined depth, wherein the surface faces the elastic displacing part, and
wherein the elastic member includes:
a block inserted into the coupling groove and protruding from the surface of the elastic displacing part; and
at least one spring interposed between the coupling groove and the block.

4. The connector terminal according to claim 3,
wherein the at least one spring includes a plurality of springs arranged symmetrically at an upper surface and a lower surface of the block.

5. The connector terminal according to claim 3,
wherein the at least one spring is either a leaf spring or a coil spring.

6. The connector terminal according to claim 5,
wherein the at least one spring is a plurality of leaf springs positioned at predetermined intervals along a longitudinal direction of the block, wherein each leaf spring has a center portion fixed to the block, and ends extending from the center portion and separated by a predetermined width.

7. The connector terminal according to claim 1,
wherein the constant distance between the support part and the lower contact-pressing unit is greater than a distance between the elastic displacing part when the elastic member is not moved and the lower contact-pressing unit.

8. The connector terminal according to claim 1,
wherein the elastic displacing part includes one or more first guide protrusions, and wherein the lower contact-pressing unit includes one or more second guide protrusions, wherein the first and second guide protrusions protrude toward each other.

9. A connector, which is directly mounted to a circuit board, comprising:
a connector terminal according to claim 1; and
a connector housing configured to accommodate the connector terminal and configured to be installed at an edge of the circuit board,
wherein the connector housing includes an upper plate and a lower plate including:
respective front portions spaced apart from each other so that the edge of the circuit board is capable of being inserted between the upper plate and lower plate to a predetermined depth; and
respective rear portions connected to each other to form a single body, and
wherein at least one of the upper plate and the lower plate includes a clamping part configured to clamp the circuit board in a second direction that is perpendicular to the first direction.

10. The connector according to claim 9,
wherein a portion of the clamping part is fitted into the upper plate in the second direction, and the portion of the clamping part is shaped in a saw-tooth pattern inclined in one direction.

11. The connector according to claim 9,
wherein the connector housing further includes holding ribs provided to respective opposing side surfaces of the connector housing, and
wherein each holding rib includes an approximately U-shaped terminal section into which the circuit board is capable of being fitted.

12. The connector according to claim 9,
wherein the connector housing further includes a latch portion configured to be hooked to a fastening hole positioned in the circuit board in advance,
wherein the upper plate includes a first upper plate part and a second upper plate part, and
wherein the latch portion is a lever type including a hooking protrusion positioned at a first end thereof and configured to be hooked to and unhooked from the fastening hole so that the first end is lifted when an opposing second end is pressed down, and wherein the latch portion is positioned between the first upper plate part and the second upper plate part.

13. The connector terminal according to claim 1, wherein the at least one elastic member includes at least one spring.

14. The connector terminal according to claim 1, wherein each of the elastic displacing part and the at least one elastic member are configured to be at least partially inserted into a depressed surface of the support part.

15. The connector terminal according to claim 1, wherein the elastic displacing part is integrally formed with the at least one elastic member.

* * * * *